United States Patent [19]

Goletz

[11] Patent Number: 4,898,392

[45] Date of Patent: Feb. 6, 1990

[54] COMBINED RING TOSS AND BALL ROLL GAMES

[76] Inventor: Louis D. Goletz, 919 E. Lincoln, Royal Oak, Mich. 48067

[21] Appl. No.: 391,184

[22] Filed: Aug. 8, 1989

[51] Int. Cl.[4] ..... A63B 67/06; A63B 71/00

[52] U.S. Cl. ..... 273/336; 273/123 R; 273/127 B; 273/398

[58] Field of Search ..... 273/336, 337, 338, 339, 273/398, 400, 123 R, 127 R, 127 B, DIG. 30

[56] References Cited

U.S. PATENT DOCUMENTS

| | | | |
|---|---|---|---|
| 163,845 | 6/1875 | Browne | 273/338 |
| 324,189 | 8/1885 | Thomas | 273/400 |
| 366,318 | 7/1887 | Hughes | 273/411 X |
| 884,277 | 4/1908 | Hughes | 273/178 R |
| 1,178,049 | 4/1916 | Beardsley | 273/336 |
| 1,230,503 | 6/1917 | Miller | 273/336 |
| 1,480,563 | 1/1924 | Morgan | 273/339 |
| 1,501,942 | 7/1924 | Carmen | 273/339 |
| 1,513,968 | 11/1924 | Crandall | 273/336 |
| 1,595,527 | 8/1926 | Schacht | 273/339 |
| 1,616,236 | 2/1927 | Schacht | 273/336 |
| 1,656,740 | 1/1928 | Kurtz | 273/180 |
| 1,705,501 | 3/1929 | Sas | 273/339 |
| 1,847,963 | 3/1932 | Hix | 273/118 R |
| 2,009,625 | 7/1935 | Knorpp | 273/336 |
| 2,080,489 | 5/1937 | Knorpp | 273/336 |
| 2,356,531 | 8/1944 | Pitar | 273/336 |
| 2,365,513 | 12/1944 | Bartle et al. | 273/339 |
| 2,366,782 | 1/1945 | Gorsuch | 273/127 B |
| 2,504,570 | 4/1950 | Neilson | 273/336 |
| 2,506,932 | 5/1950 | McAfee | 273/336 |
| 2,538,128 | 1/1951 | Simmons | 273/339 |
| 3,115,340 | 12/1963 | Stasiuk | 273/398 X |
| 3,119,619 | 1/1964 | Frank | 273/336 |
| 3,190,657 | 6/1965 | Johnson | 273/181 A |
| 3,231,278 | 1/1966 | Boulanger | 273/127 R X |
| 3,386,736 | 6/1968 | Fong | 273/338 |
| 3,406,973 | 10/1968 | Poole | 273/123 R |
| 3,451,680 | 6/1969 | Koleske | 273/127 R X |
| 3,802,704 | 4/1974 | Genua | 273/336 |
| 4,129,298 | 12/1978 | Richardson et al. | 273/339 |
| 4,132,410 | 1/1979 | Montagna | 273/339 |
| 4,204,682 | 5/1980 | Brown | 273/401 |
| 4,239,228 | 12/1980 | Norman et al. | 273/DIG. 30 X |
| 4,433,841 | 2/1981 | Kim et al. | 273/338 |
| 4,718,677 | 1/1988 | Barnes | 273/DIG. 30 X |
| 4,726,591 | 2/1988 | Johnson | 273/339 |
| 4,805,916 | 2/1989 | Zentner, Jr. | 273/336 |

*Primary Examiner*—William H. Grieb
*Attorney, Agent, or Firm*—Peter D. Keefe

[57] ABSTRACT

A combined ring toss game and ball roll game. In a first embodiment, representing the ring toss game, a pair of target standards are used as targets for the rings. Each target standard is cylindrically shaped and is segmented so that an integral staking rod may be alternatively stored internal to the target standard or exposed at the lower end thereof for purposes of insertion into soil. When the staking rod is not used for holding the target standard in an upright attitude outdoors, the target standard is connected with a flat base. The flat base being suitable for use outdoors or indoors. Two differently colored sets of three rings each are preferred, and the object of the game is to score points based upon the accuracy of the toss of each ring in a set. In a second embodiment, representing the ball roll game, the two sets of three rings of the first embodiment are used as targets. A hook portion or a loop portion of a hook and loop type fastener is adhered to selected locations on the rings of each set so that the rings may be selectively connected together in a "V" shape target. The object of the game is to hand toss a rolling ball toward the rings, with accuracy of the roll relative to the rings contributing to the score.

14 Claims, 2 Drawing Sheets

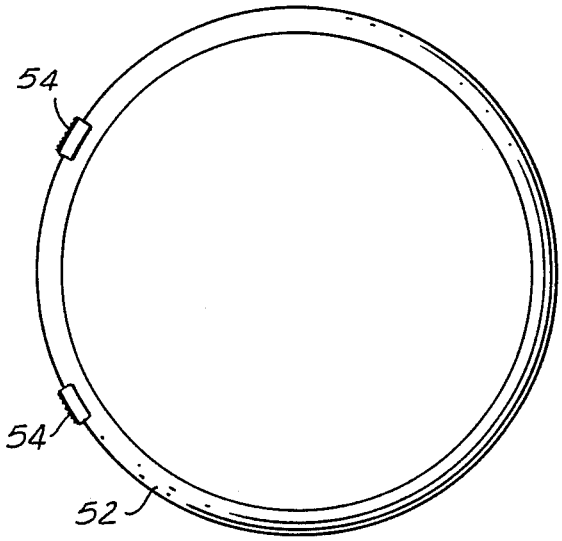
FIG.4
FIG.5
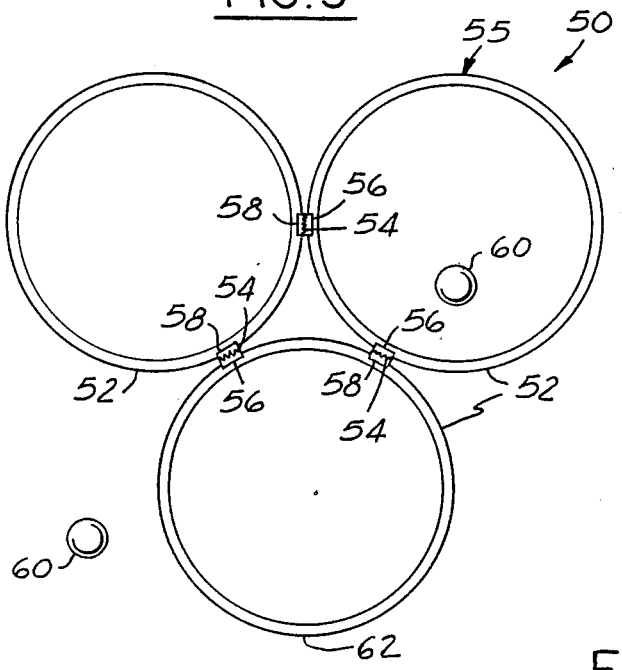
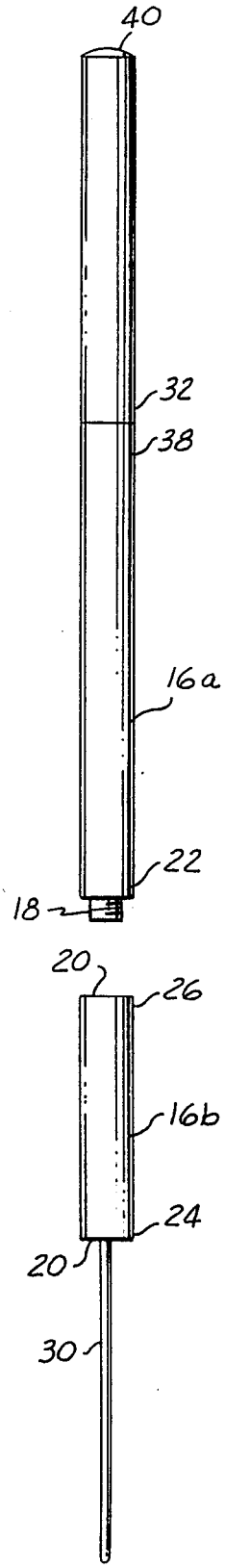
FIG.6
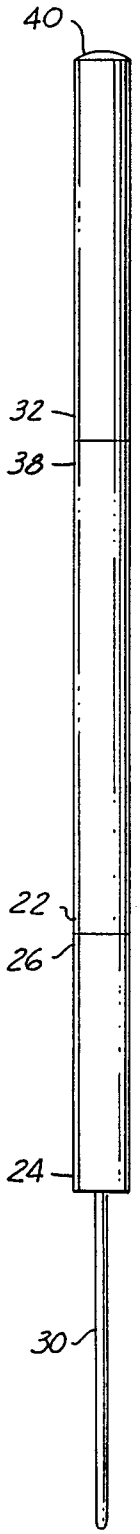
FIG.7

COMBINED RING TOSS AND BALL ROLL GAMES

BACKGROUND OF THE INVENTION

1. Field of the Invention

The present invention relates to ring based games, particularly to ring games in which one or more rings are to be tossed onto one or more upstanding standards. The present invention further relates to ball rolling games in which one or more flat laying rings serve as a target.

2. Description of the Prior Art

Games for recreational entertainment that utilize cylindrical standards which serve as a target for tossed items are well known in the prior art. The best known game of this kind is "horseshoes". Horseshoes is played using real or simulated horseshoes which are tossed at an upstanding standard which is hammered partially into the ground. Horseshoes, while being an extremely exciting game, suffers from several very important disadvantages which have resulted in a plethora of alternative games being devised in the prior art. These disadvantages include: the heaviness of the horseshoes for young persons and persons having debilitation such as arthritis, the need to pound the standards (or stakes) into the ground which can be a difficult task for the aforesaid class of users, the potential for harm should a tossed horseshoe accidentally miss its mark and instead contact a fragile article or a bystander, and, finally but certainly not least, the game must be played outdoors on soil which, to the dismay of homeowners who love a manicured looking lawn, will become thoroughly torn-up due to repeated impacts of the horseshoes.

In the prior art, alternative solutions to the problems inherent with the apparatus used in horseshoes have more-or-less universally included rings which are lighter than the heavy horseshoe and which can add excitement by the participants trying to use skill to cause the ring to be caught by the standard.

There are several classes of ring toss games. A first class uses no standard at all; a second class uses at least one standard connected with a flat, stabilizing base; a third class uses at least one standard where the standard is alternatively connectable to a base or is driven into the ground; a fourth class incorporates at least one standard where the standard has horizontal projections; and finally a fifth class uses multiple standards connected upon a singlular base.

An example of the first class of games in U.S. Pat. No. 4,204,682 to Brown, dated May 27, 1980, where a hole is used rather than a standard.

Examples of the second class of games are U.S. Pat. Nos. 1,178,049 to Beardsley, dated Apr. 4, 1916; 1,616,236 to Schacht, dated Feb. 1, 1927; 2,009,625 to Knorpp, dated July 30, 1935; 2,080,489 to Knorpp, dated May 18, 1937; 3,356,531 to Pitar, dated Aug. 22, 1944; 2,506,932 to McAfee, dated May 9, 1950; and 3,802,704 to Genua, dated Apr. 9, 1974.

Examples of the third class of games, which are most similar to the first embodiment of the present invention, are U.S. Pat. Nos. 1,230,503 to Miller, dated June 19, 1917; and 2,504,570 to Neilson, dated Apr. 18, 1950.

Examples of the fourth class of games are U.S. Pat. Nos. 1,480,563 to Morgan, dated Jan. 15, 1924; 2,365,513 to Bartle et al, dated Dec. 19, 1944; 3,119,619 to Frank, dated Jan. 28, 1964; 4,132,410 to Montagna, dated Jan. 2, 1979; and 4,726,591 to Johnson, dated Feb. 23, 1988.

Finally, examples of the fifth class of games are U.S. Pat. Nos. 163,845 to Browne, dated June 1, 1875; 324,189 to Thomas, dated Aug. 11, 1885; 1,501,942 to Carmen, dated July 22, 1924; 1,595,527 to Schacht, dated Aug. 10, 1926; 1,705,501 to Sas, dated Mar. 19, 1929; 2,538,128 to Simmons, dated Jan. 16, 1951; 3,386,736 to Fong, dated June 4, 1968; and 4,129,298 dated Dec. 12, 1978.

Some overlapping in classes may occur among the examples listed above.

While a common thread exists among these prior art devices, the tossing of one or more rings (instead of heavy horseshoes) toward a target for purposes of gaining a highest score based upon accuracy of the toss, there still remains a need in the prior art to provide a ring toss game in which the game may be played indoors or outdoors, with the standard being easily convertible for either environment of use, and with the standard further being adjustable for both play and shipping.

Further to the discussion above, are a category of games in which one or more balls are rolled toward a target, the accuracy of the roll determining the score of the players. A common class of these is found in golf putting targets, such as U.S. Pat. Nos. 3,190,657 to Johnson, dated June 22, 1965; 1,656,740 to Kurtz, dated Jan. 17, 1928; and 884,277 to Hughes, dated Apr. 7, 1908. Another class of these is found in games in which the ball is manipulated with a mallet or stick toward a particular target configuration, such as U.S. Pat. Nos. 2,366,782 to Gorsuch, dated Jan. 9, 1945; 1,847,963 to Hix, dated Mar. 1, 1932; and 366,318 to Hughes, dated July 12, 1887. Finally, and most relevant to the second embodiment of the present invention, are ball games in which the balls are rolled by hand toss, such as U.S. Pat. Nos. 3,451,680 to Poole, dated Oct. 22, 1968; and 3,231,278 to Boulanger, dated Jan. 25, 1966.

These ball rolling games, while entertaining, still do not provide the flexibility and depth of enjoyment that is possible with a target which has a selective number multiple components that are easily connected together.

SUMMARY OF THE INVENTION

The present invention has two game embodiments: a first which is a ring toss game (called "Ringos") and a second which is a ball roll game (called "Roller Ball").

In the first embodiment a pair of target standards are used as targets for the rings. Each target standard is cylindrically shaped and is segmented so that an integral staking rod may be alternatively stored internal to the target standard or exposed at the lower end thereof for purposes of insertion into soil. When the staking rod is not used for holding the target standard in an upright attitude outdoors, the target standard is connected with a flat base. The flat base is suitable for use outdoors or indoors. Two differently colored sets of three rings each are preferred, and the object of the game is to score points based upon the accuracy of the toss of each ring in a set.

The second embodiment utilizes the two sets of three rings of the first embodiment of the present invention. A hook portion or a loop portion of a hook and loop type fastener is adhered to selected locations on the rings of each set so that the rings may be selectively connected together in a "V" shape. The object of the game is to hand toss a rolling ball toward the rings, with accuracy of the roll relative to the rings contributing to the score.

Accordingly, it is an object of the present invention to provide a ring toss game in which each target standard is segmented so that an integral rod, provided for staking into the ground, may be selectively stored safely within the standard during shipping or simply when it is not needed.

It is an additional object of the present invention to provide a ring toss game in which each target standard is segmented for selectively varying the height of the standard for purposes of ease of shipment or enjoyment of play.

It is another object of the present invention to provide a ring toss game in which each target standard is structured to accommodate being selectively staked into the ground or connected with a stabilizer base.

It is yet another object of the present invention to provide a ring toss game having target standards and rings which permit play either outdoors or indoors.

It is still an additional object of the present invention to provide a ring toss game which is safely and enjoyably playable by children and by disabled persons.

It is yet an additional object of the present invention to provide a ball rolling game constructed from at least one ring and preferably three rings which are selectively held together in a "V" shape configuration using a hook and loop fastener.

It is yet further an additional object of the present invention to commonly utilize rings for the ring toss game and for the rolling ball game.

These, and additional objects, advantages, features and benefits of the present invention will become apparent from the following specification.

BRIEF DESCRIPTION OF THE DRAWINGS

FIG. 4 is a plan view of a ring common to use in both the first and second preferred embodiments of the present invention.

FIG. 5 is a plan view of a set of rings connected together to form a target for the second preferred embodiment of the present invention.

FIG. 6 is a side view of the target standard of the first preferred embodiment of the present invention in which the lower segment thereof has been removed and inverted, thereby exposing a staking rod.

FIG. 7 is a side view of the target standard of FIG. 6, now showing the lower segment reattached and ready for thrusting of the staking rod into the ground.

DETAILED DESCRIPTION OF THE PREFERRED EMBODIMENTS

Figures 1, 2, 3, 8:
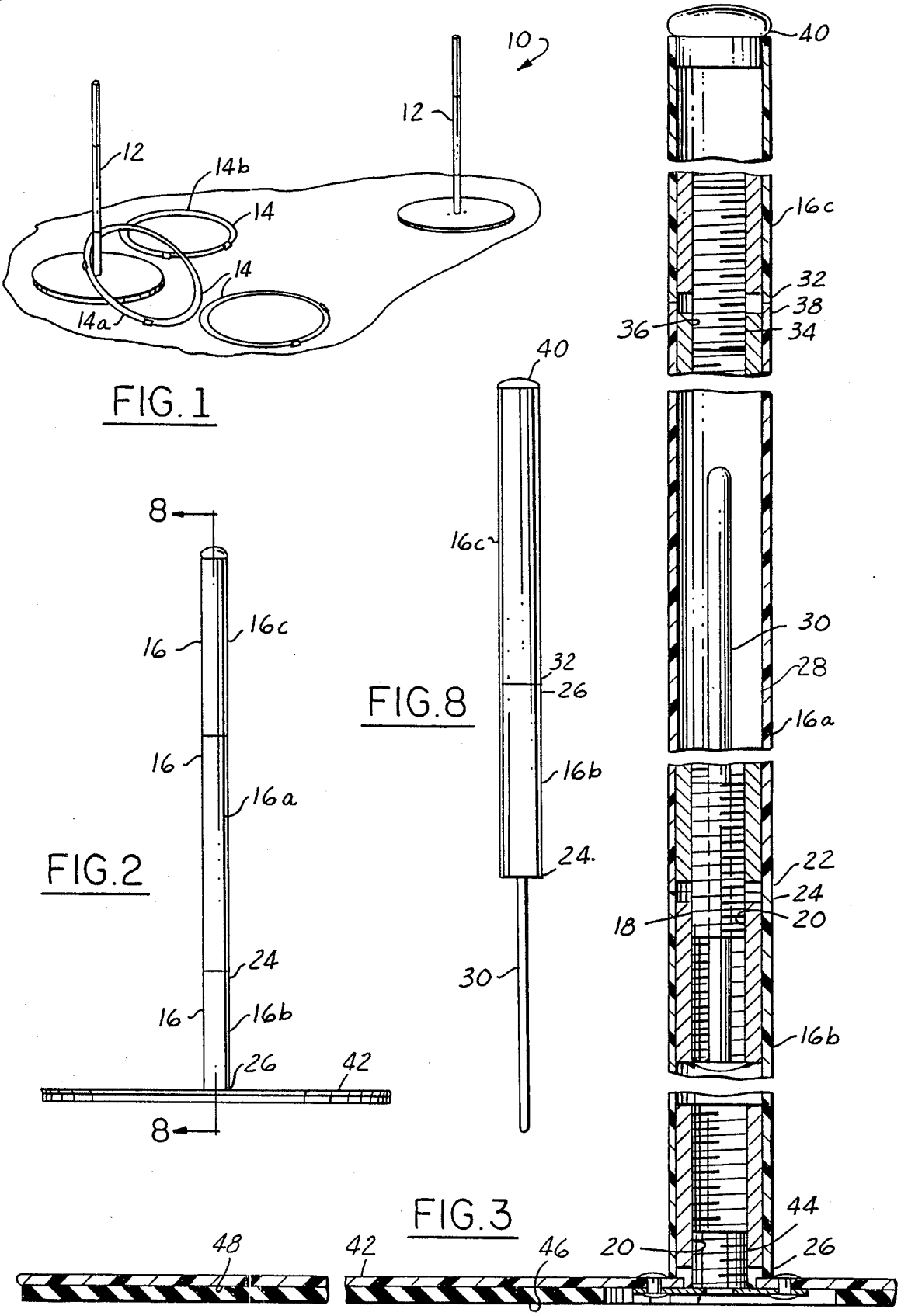
FIG. 1 is a perspective view of the first preferred embodiment of the present invention in operation.
FIG. 2 is a side view of the target standard according to the first preferred embodiment of the present invention.
FIG. 3 is a part sectional side view of the target standard as seen along lines 3—3 in FIG. 2.
FIG. 8 is a side view of the target standard with the main segment thereof removed.

Referring now to the Drawing, the first preferred embodiment of the present invention will be described, followed by the second preferred embodiment of the present invention.

FIG. 1 shows the first preferred embodiment of the present invention which constitutes a ring toss game 10. The ring toss game includes two spaced apart target standards 12 and two sets of rings 14, one set being shown after having been tossed at one of the target standards. The object of the game is to toss the rings 14 toward a selected target standard and attempt to get at least one ring onto the target standard, as shown in FIG. 1 with ring 14*a*, or at least come close, as shown by ring 14*b*. The operation of the game will be fully elaborated below.

Referring now also to FIGS. 2, 3, 6 and 7, it will be seen that each target standard 12 is composed of a plurality of cylindrical segments 16. It is preferred that the segments 16 be connected together by interaction between male threads 18 and female threads 20 located, respectively, at the abutment of each adjoining segment. The aforesaid threaded connection system can be understood more clearly by reference to the connection between main segment 16*a* and lower segment 16*b*. As can best be perceived from FIGS. 3 and 6, the lower end 22 of the main segment 16*a* has a male threaded fitting 18, while both ends 24 and 26 of the lower segment 16*b* have female threaded fittings 20. Thusly, either end 24 or 26, respectively, of the lower segment 16*b* may be selectively threaded onto the male threaded fitting 18 located at the lower end 22 of the main segment 16*a*. One end 24 of the lower segment 16*b* has connected therewith an axially positioned staking rod 30, the purpose of which being to insert it into the ground so as to provide vertical anchorage for the target standard 12, the length of the staking rod, on the order of six inches, being determined thereby. In order that the staking rod 30 be received into the lower end 22 of the main segment 16*a*, the main segment is hollow so as to form an axial aperture 28 therein. Indeed, except for the staking rod 30, the segments 16 may be constructed hollow cylindrical material. In this respect, it is preferred that the segments be constructed of plastic and that the threaded fittings 18 and 20 be constructed of plastic or metal, the case of metal fittings being shown in the Drawing. In the event the threaded fittings are constructed of plastic, it is preferred that each segment 16 be constructed as a single piece of plastic fittings being integral with the segments themselves.

It is further preferable to provide an upper segment 16*c* which has a lower end 32 having a male threaded fitting 34 which threads onto a female threaded fitting 36 at the upper end 38 of the main segment 16*a*. Including an upper segment 16*c* serves two purposes: (1) facility to minimize the length of the target standard for shipping, and (2) adjust the height of the target standard by threading the upper segment 16*c* onto the lower segment 16*b*, thereby shortening the target standard by selectively eliminating the main segment 16*a*, as for example as shown in FIG. 8. The upper segment 16*c* includes a cap 40. The dimensions of the target standards are preferred to be that of regulation horseshoes stakes, the total length of the target standard being preferred to be on the order of eighteen inches, and its diameter on the order of an inch.

Each target standard 12 is held in a vertical orientation by two different mechanisms: (1) by operation of the staking rod 30 being driven into the ground, and (2) by operation of threaded attachment to a base 42. In the second case, the base 42 is preferred to be of circular shape on the order of twelve inches in diameter and have connected thereto at its center a male fitting 44. The male fitting 44 is structured to threadingly engage the female fitting 20 at the end 26 of the lower segment 16*b*. Thusly, the target standards 12 may be staked into the ground or held upright by a base depending on the user's desire with respect to indoor or outdoor operation of the invention. It is further preferred to provide a frictional coating 46 on the bottom 48 of the base to minimize potential slipping of the target standard 12 when it is subjected to ring contact when the base 42 is resting upon a floor surface.

FIGS. 1, 4 and 5 show the structural configuration of the rings 14 used in both the first and second preferred embodiments of the present invention. The rings 12 are preferred to be constructed of a plastic material, having a diameter on the order of twelve inches, a cross-section on the order of one-half inch and a weight in the neighborhood of four ounces.

It is preferred that each of the rings and target standards have distinguishing indicia, such as being of different colors; that is, one set of rings being of one of the colors of the target standards and the other set of rings be of the other color. It is preferred that the colors be fluorescent. It is further preferred that the target standards and the rings be made of or coated with a luminescent material so to enable playing in the dark. It is still further preferred that provision be made for connecting light sticks with both the target standards and the rings so that night play may be engaged; indeed, in this regard, the target standards might even have battery powered internal illumination.

The ring toss game 10 is played as follows. The game is preferred to be played by two or four players. The distance between the target standards is preferred to be 20 to 25 feet for children and 30 to 36 feet for adults. In order to position the target standards, either (1) the male threaded fitting 44 on the base 42 is threaded into the female threaded fitting 20 on the lower segment **16*b* and the base positioned as indicated above, or (2) the lower segment 16*b* is unscrewed from the main segment 16*a***, inverted and then rethreaded onto the main segment so that the staking rod is projecting axially downward for insertion into the ground at the aforesaid positions.

If two players play, each receives a set of rings; if four players play, they are divided into teams with each partner at each target standard. Before starting the game each player tosses a ring to see who gets closest to the target standard; the closest player goes first. This player tosses all of his or her set of rings during the turn. The other team's player at that target standard then throws the other set of rings, and so forth at the opposite target standard.

Points are earned as follows. To score a point the ring must land within one diameter of a ring from the target standard. Whichever player's rings are closest to the target standard, that person gets one point for each ring located within one diameter of the target standard. If a ring goes around the target standard, then that player gets three points; but, if his or her opponent also tosses a ring around the target standard, then who ever has a ring rim closest to the target standard gets the three points, cancelling the three points of the other player. In the next round the player who had the most points in the last round goes first. The player or team to first reach 21 points wins. If when the game is over there is a tie score, then each player tosses a ring, and the player (or team) tossing his or her ring closest to the target standard wins.

Now referring again to FIGS. 4 and 5, the second preferred embodiment of the present invention, a ball roll game 50, will be described.

The rings 14 have attached to the rim 52, at two locations, hook and loop fasteners 54 of the kind manufactured by Velcro USA, Inc. The location of each portion of the hook and loop fastener is determined by the intersection points of the rims of the rings when they are laid out in a "V" shaped pattern so as to form a target 55, as shown in FIG. 5. In order that a hook portion of the hook and loop fastener interacts with a loop portion of the hook and loop fastener, the hook portion and the loop portion should be adhesively attached to the ring rim in a sequence that ensures hook and loop interaction. By example, FIG. 5 shows hook portions 56 and loop portions 58 at locations that ensure the required hook and loop interaction so that the three rings are connected together.

The ball roll game 50 is played as follows. Six conventional balls 60 of approximately hardball size weight is preferred; a dense rubber ball being most preferred. Further, it is preferred that three of the balls be colored one color and the other three balls be colored another color, it being preferred that the two colors chosen match those of the rings. Each set of rings 14 forms a "V" shaped target 55 for the balls. Two targets are formed of the six rings. The targets are located 20 to 25 feet apart when the players are children and are located 30 to 35 feet apart when the players are adults, with the point 62 of the "V" facing the players. Each player gets three balls of one color where there are two players. When there are four players they are divided into teams in which partners stand adjacent one target and the other team players adjacent the other target, and the balls are divided among the teams. To start the game, each player rolls a ball by hand toss, the player having the closest ball to the target goes first, tossing all three balls. Then the other players play in sequential manner. The player who scores highest in the present round goes first in the next round.

Points are earned as follows. A point is given for each ball located within one ball diameter of a ring rim, provided that player has the closest ball to the ring rims. If a ball ends its roll inside a ring, that player gets three points, unless the opponent also gets a ball inside a ring. If so, then neither player gets points. However, if a first player knocks out an opponent's ball from inside the ring, and his or her ball ends up inside the ring, then the first player gets no points and the opponent gets three points. The first player or team to reach 21 points wins. In the event of a tie, then each player rolls a ball and the player (or team) tossing the closest ball to the target wins.

To those skilled in the art to which this invention appertains, the above described preferred embodiments may be subject to change or modification. For instance, the ball roll game can be played with single ring targets, rather than three ring targets, in which case the hook and loop fasteners could be dispensed with. Further, for instance, the segments of the target standards may be alternatively interconnected using a friction fit or snap fit. Such change or modification can be carried out without departing from the scope of the invention, which is intended to be limited only by the scope of the appended claims.

What is claimed is:

1. A ring toss game playable on a surface, comprising:

a plurality of rings;

a pair of target standards, each target standard having an elongate cylindrical shape, each target standard being comprised of at least two segments, said at least two segments comprising:

a main segment having a first end and a second end, said main segment having an axial aperture adjacent said first end thereof;

a lower segment having a first end and a second end, either of said first end and said second end of said lower segment being removably connectable with said first end of said main segment;

first connection means connected with said first and second ends of said lower segment and said first end of said main segment for removably connecting said first end and said second end of said lower segment to said first end of said main segment; and a staking rod connected with said first end of said lower segment, said staking rod being inserted into said axial aperture of said main segment when said first end of said lower segment is connected with said first end of said main segment;

a pair of bases, each base being structured for resting upon said surface, each base selectively anchoring one target standard of said pair of target standards; and second connection means connected with each said base for removably connecting said second end of one said lower segment to each said base;

whereby said staking rod anchors its respective target standard with respect to said surface by being penetrated thereinto when said second end of said lower segment is connected with said first end of said main segment.

2. The ring toss game of claim 1, wherein each said target standard further comprises:

an upper segment, said upper segment having a first end and a second end, said first end of said upper segment being selectively connectable to said first end and said second end of said lower segment; and third connection means connected with said first end of said upper segment for removably connecting said first end and said second end of said lower segment.

3. The ring toss game of claim 2, wherein there are provided six rings, each ring having a rim, said six rings being grouped into two sets of three rings each; further wherein said rim of each ring has connected thereto a selected portions of a hook and loop fastener so that each ring of each set of three rings may be interconnected so as to form a "V" shaped pattern.

4. The ring toss game of claim 3, wherein one target standard has one indicia located thereon and the other target standard has a second indicia located thereon; further wherein one set of rings has said first indicia located thereon and the other set of rings has said second indicia located thereon; and further wherein each said base has connected thereto an anti-slip material where said base contacts said surface.

5. A ball roll game for playing with at least one ball on a surface, comprising two targets for rolling said at least one ball theretoward, each target comprising:

three rings, each ring having a rim, said three rings being laid out in a "V" shaped pattern, each ring having a point of intersection with each other ring of said target;

a selected portion of a hook and loop fastener means attached to the rim of each ring of each said target at each said point of mutual intersection for interconnecting each ring of each said target.

6. The ball roll game of claim 5, wherein one set of rings has a first indicia thereon and the other set of rings has a second set thereon.

7. The ball roll game of claim 6, further comprising two sets of balls, at least one ball being in each set, one set of balls having said first indicia thereon and the other set of balls having said second indicia thereon.

8. A combined ring toss game and ball roll game playable on a surface, said ball roll game being playable with at least one ball, said combined ring toss game and ball roll game comprising:

six rings, each ring having a rim, three rings forming a first set and the remaining three rings forming a second set, the rings of said first set having a first indicia thereon, the rings of said second set having a second indicia thereon, selected portions of a hook and loop fastener means attached to the rim of each respective ring of said first and second sets for removably interconnecting each ring of each set so as to form a "V" shaped pattern;

a pair of target standards, each target standard having an elongate cylindrical shape, one target standard having said first indicia thereon, the other target standard having said second indicia thereon, each target standard being comprised of at least two segments, said at least two segments comprising:

a main segment having a first end and a second end, said main segment having an axial aperture adjacent said first end thereof;

a lower segment having a first end and a second end, either of said first end and said second end of said lower segment being removably connectable with said first end of said main segment;

first connection means connected with said first and second ends of said lower segment and said first end of said upper segment for removably connecting said first end and said second end of said lower segment to said first end of said main segment;

a staking rod connected with said first end of said lower segment, said staking rod being inserted into said main segment when said first end of said lower segment is connected with said first end of said main segment, said staking rod anchoring its respective target standard with respect to said surface by being penetrated thereinto when said second end of said lower segment is connected with said first end of said main segment;

a pair of bases, each base being structured for resting upon said surface, each base selectively anchoring one target standard of said pair of target standards; and second connection means connected with each said base for removably connecting said second end of said lower segment to each said base.

9. The ring toss and ball roll game of claim 8, wherein each said target standard further comprises:

an upper segment, said upper segment having a first end and a second end, said first end of said upper segment being selectively connectable to said first end and said second end of said lower segment; and third connection means connected with said first end of said upper segment for removably connecting said first end and said second end of said lower segment.

10. The ring toss and ball roll game of claim 9, wherein each said base has connected thereto an anti-slip material where said base contacts said surface.

11. The ring toss and ball roll game of claim 10, further comprising two sets of balls, at least one ball being in each set, one set of balls having said first indicia thereon and the other set of balls having said second indicia thereon.

12. A target standard for a game playable on a surface, said target standard having an elongate cylindrical shape, said target standard being comprised of at least two segments, said at least two segments comprising:

a main segment having a first end and a second end, said main segment having an axial aperture adjacent said first end thereof;

a lower segment having a first end and a second end, either of said first end and said second end of said lower segment being removably connectable with said first end of said main segment;

first connection means connected with said first and second ends of said lower segment and said first end of said upper segment for removably connecting said first end and said second end of said lower segment to said first end of said main segment;

a staking rod connected with said first end of said lower segment, said staking rod being inserted into said main segment when said first end of said lower segment is connected with said first end of said main segment, said staking rod anchoring said target standard with respect to said surface by being penetrated thereinto when said second end of said lower segment is connected with said first end of said main segment;

said target standard further comprising:

a base structured for resting upon said surface, said base selectively anchoring said target standard; and second connection means connected with said base for removably connecting said second end of said lower segment to said base.

13. The target standard of claim 12, wherein said target standard further comprises:

an upper segment, said upper segment having a first end and a second end, said first of said upper segment being selectively connectable to said first end and said second end of said lower segment; and third connection means connected with said first end of said upper segment for removably connecting said first end and said second end of said lower segment.

14. The target standard of claim 13, wherein said base has connected thereto an anti-slip material where said base contacts said surface.

* * * * *